US005655182A

United States Patent [19]

Sanchez et al.

[11] Patent Number: 5,655,182

[45] Date of Patent: Aug. 5, 1997

[54] METHOD AND APPARATUS FOR REUSING A PHOTORECEPTOR AND GEAR ASSEMBLY

[75] Inventors: Ismael R. Sanchez, Rochester; Warren F. Brydges, Macedon; Robert S. Foltz, Rochester; William A. Hammond, Rochester; Richard C. Petralia, Rochester; Eugene A. Swain; Thong H. Vo, both of Webster; John K. Williams, Fairport, all of N.Y.

[73] Assignee: Xerox Corporation, Stamford, Conn.

[21] Appl. No.: 485,080

[22] Filed: Jun. 7, 1995

[51] Int. Cl.[6] ..... G03G 15/00

[52] U.S. Cl. ..... 399/117; 399/167

[58] Field of Search ..... 399/111, 116, 399/117, 167; 492/15

[56] References Cited

U.S. PATENT DOCUMENTS

| | | | |
|---|---|---|---|
| 4,386,839 | 6/1983 | Kumagai et al. | 399/116 |
| 4,400,077 | 8/1983 | Kozuka etal. | 399/117 |
| 4,561,763 | 12/1985 | Basch | 399/116 |
| 4,839,690 | 6/1989 | Onoda et al. | 399/117 |
| 4,914,478 | 4/1990 | Yashiki | 399/117 |
| 4,975,743 | 12/1990 | Surti | 399/111 |
| 4,975,744 | 12/1990 | Ebata et al. | 399/90 |
| 5,052,090 | 10/1991 | Kitaura et al. | 399/159 |
| 5,210,574 | 5/1993 | Kita | 399/117 |
| 5,353,099 | 10/1994 | Tsunoda | 399/167 |
| 5,357,321 | 10/1994 | Stenzel et al. | 399/167 |
| 5,402,207 | 3/1995 | Michlin | 399/117 |

FOREIGN PATENT DOCUMENTS

| | | |
|---|---|---|
| 4-356090 | 12/1992 | Japan . |
| 6-110361 | 4/1994 | Japan . |

*Primary Examiner*—William J. Royer
*Attorney, Agent, or Firm*—Oliff & Berridge

[57] ABSTRACT

A reusable photoreceptor assembly has a gear assembly removable from a photoreceptor. A square leaf spring or ring is used to secure and remove the gear assembly to and from the photoreceptor, thereby avoiding damage to both the gear assembly and photoreceptor during the removal of the gear assembly. The undamaged gear assembly and photoreceptor may then be reused.

19 Claims, 2 Drawing Sheets

METHOD AND APPARATUS FOR REUSING A PHOTORECEPTOR AND GEAR ASSEMBLY

CROSS REFERENCE TO RELATED APPLICATION

This application is related to U.S. patent application Ser. No. 08/483,000, filed concurrently with this application and entitled "Resiliently Biased Endcaps for Photoconductive Drums" by Moritz P. Wagner.

BACKGROUND OF THE INVENTION

1. Field of the Invention

The present invention relates to a method and apparatus for reusing photoreceptor and gear assemblies used, for example, in photographic reproduction machines.

2. Description of Related Art

The recovery and reuse of machine components is commonplace among manufacturers of sophisticated electronic equipment, such as photographic reproduction machines. The impetus for the recovery and reuse of these components is both environmental and economic. At the heart of any photographic reproduction machine or copier is a photoreceptor assembly ("P/R assembly"). One part of the assembly is a photoreceptor which is rotated to reproduce images. Typically, this photoreceptor is rotated using a gear assembly which is also a part of the P/R assembly. This rotation requires that the gear assembly be attached to the photoreceptor. Conventionally, a portion of the gear assembly is glued to the inside surface of a hollow, cylinder-shaped photoreceptor. When such a photoreceptor is no longer functional, the gear assembly must then be separated from the photoreceptor. In practice, efforts to separate the gear assembly and photoreceptor have proven unsatisfactory since this requires a great dear of time and care to assure that the photoreceptor and gear assembly are not damaged upon breaking the glued seal with the photoreceptor. Many times the gear assembly is cracked or broken, parts of it remaining glued to the inside of the photoreceptor. Likewise, the photoreceptor's surface is damaged due to the force required to break the glued seal. There is therefore a need for a glueless method of securing and then removing gear assemblies from the inside surface of photoreceptors which allows the gear assemblies and photoreceptors to be reused.

SUMMARY OF THE INVENTION

This invention therefore provides a photoreceptor assembly comprising a reusable gear assembly which is removably secured to a photoreceptor after inserting the gear assembly into an open end of the photoreceptor.

The invention also provides for a gear assembly having a chamfered end which is positioned in the open end of the photoreceptor, a threaded protrusion which extends from the chamfered end of the gear assembly, and securing means threadably connected to the threaded protrusion to selectively move in a first axial direction towards the chamfered end upon rotation of the gear assembly in a first rotational direction to lock the securing means against an inside surface of the photoreceptor, and then to move in a second axial direction away from the chamfered end upon rotation of the gear assembly in a second rotational direction to unlock the securing means from the inside surface of the photoreceptor.

According to one aspect of the present invention, after movement of the gear assembly in the first axial direction, the securing means radially expands to lock the securing means to an inside surface of the photoreceptor which in turn secures the gear assembly to the inside surface of the photoreceptor. Upon movement of the gear assembly in the second direction, the securing means radially contracts to unlock the securing means from the inside surface of the photoreceptor which in turn releases the gear assembly from the inside surface of the photoreceptor.

BRIEF DESCRIPTION OF THE DRAWINGS

These and other aspects of the invention will become apparent from the following description as exemplified in preferred embodiments and in relation to the accompanying drawings, in which.

DETAILED DESCRIPTION OF PREFERRED EMBODIMENTS

Figure 1:
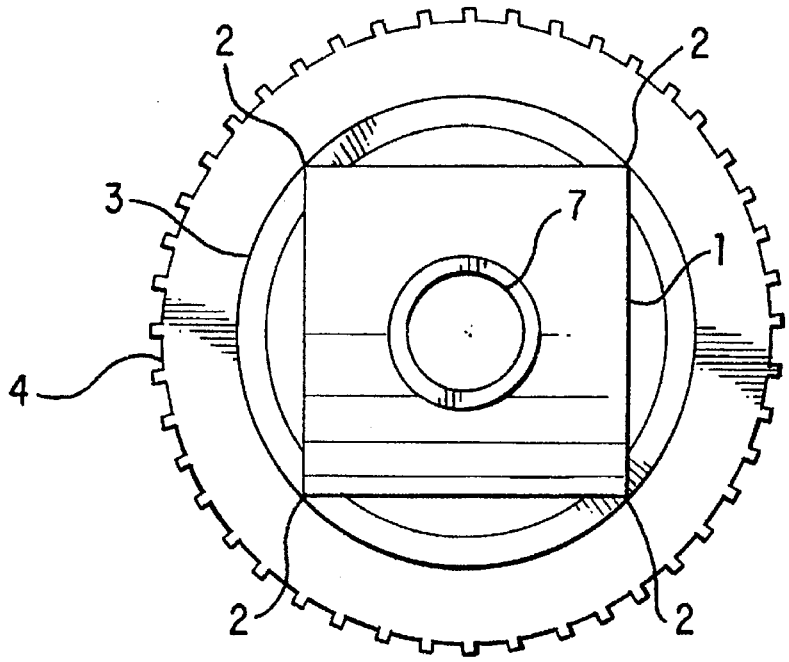
FIG. 1 is a plan view depicting the use of an expandable square, threaded leaf spring as the securing means according to one embodiment of the present invention.
Figure 2:
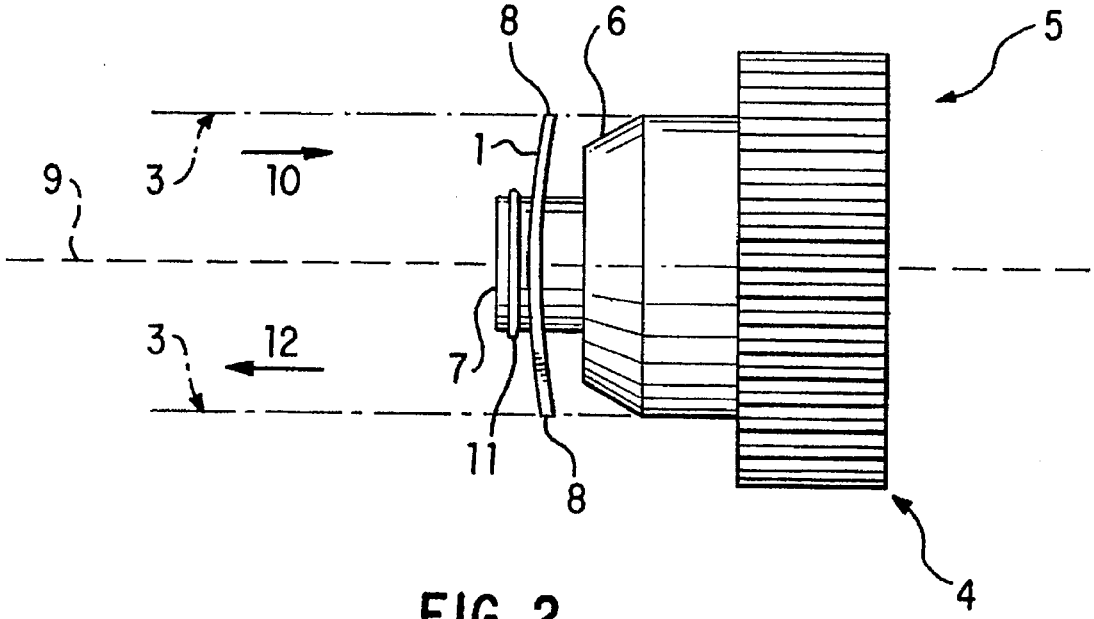
FIG. 2 is a side view depicting placement of a reusable gear assembly using the expandable square, threaded leaf spring within a photoreceptor according to one embodiment of the present invention.

FIG. 1 is a plan view of an expandable square, threaded leaf spring or securing means 1 expandably secured at points 2 to an inside surface 3 of a photoreceptor. FIG. 2 is a side view depicting placement of a reusable gear assembly 5 which includes a gear 4 inside the photoreceptor. The combination of a gear assembly 5 and photoreceptor is referred to as a P/R assembly. The gear assembly 5 may be of a unibody plastic design.

A portion of the gear assembly 5 is placed into an open end of the photoreceptor. The gear assembly has a chamfered end 6 upon which the securing means or square leaf spring rests before expansion. A protrusion or hollow shaft 7 having exterior threads extends from the chamfered end 6 of the gear assembly 5. The square leaf spring 1 has an internally threaded bore which allows it to be threadably connected to the protrusion 7. Portions or end corners 8 of the square leaf spring 1 rest on the chamfered end 6 of the gear assembly 5. When the gear assembly 5 is rotated in a first rotational direction about a central axis 9, the center of the securing means or square leaf spring 1 moves in a first axial direction 10 towards the chamfered end 6. This movement causes the corners 8 to expand radially, locking the securing means to the inside surface 3 of the photoreceptor. This in turn secures the gear assembly 5 to the inside surface 3 of the photoreceptor as well. The first rotational direction matches a drive direction of the photoreceptor.

In addition, the gear assembly 5 comprises torque controlling means 11 located on the protrusion 7 for substantially limiting the position of the securing means 1. The torque controlling means 11 may comprise a lock-out clip or any equivalent capable of limiting the position of the securing means 1. When the gear assembly is rotated in the second rotational direction, the center of the securing means 1 moves in a second axial direction 12 away from the chamfered end 6 of the gear assembly 5. This allows the end portions 8 of the securing means 1 to radially contract toward a rest position, unlocking the securing means 1 from the inside surface 3 of the photoreceptor which permits the removal of the gear assembly 5 from the photoreceptor. The torque controlling means 11 limits the amount of movement of the securing means 1 away from the chamfered end 6 so that the securing means does not unthread from the shaft 7.

As the gear assembly 5 is inserted into the photoreceptor the securing means 1 frictionally contacts the inside surface 3 of the photoreceptor. When the gear assembly 5 is rotated in the first rotational direction torque is applied to the gear assembly in the direction of the protrusion's threads which forces the square leaf spring 1 and the gear assembly 5 to move towards each other. This causes the square leaf spring 1 to flatten out and corners 8, which are resting on the chamfered end 6, to expand radially outwards towards the inside surface 3 of the photoreceptor. These corners 8 dig into the inside surface 3 which may be made of aluminum, forming an interference. This interference "locks" the securing means 1 and gear assembly 5 into the photoreceptor.

A quarter or half turn in the first rotational direction can be enough for locking the securing means 1 and gear assembly 5 to the photoreceptor. Additional torque applied during use of the P/R assembly will keep the photoreceptor and gear assembly 5 locked together.

Though in the above described embodiment the securing means 1 takes the shape of a square leaf spring this leaf spring may be rectangular or any other symmetrical, geometric shape.

Since the square leaf spring 1 is in contact with the inside surface 3 of the photoreceptor, it can serve as a grounding strip. A shaft (not shown), which extends lengthwise through the photoreceptor and passes through the protrusion or hollow threaded shaft 7, in conjunction with the square leaf spring, may provide grounding for the P/R assembly.

Figure 3:
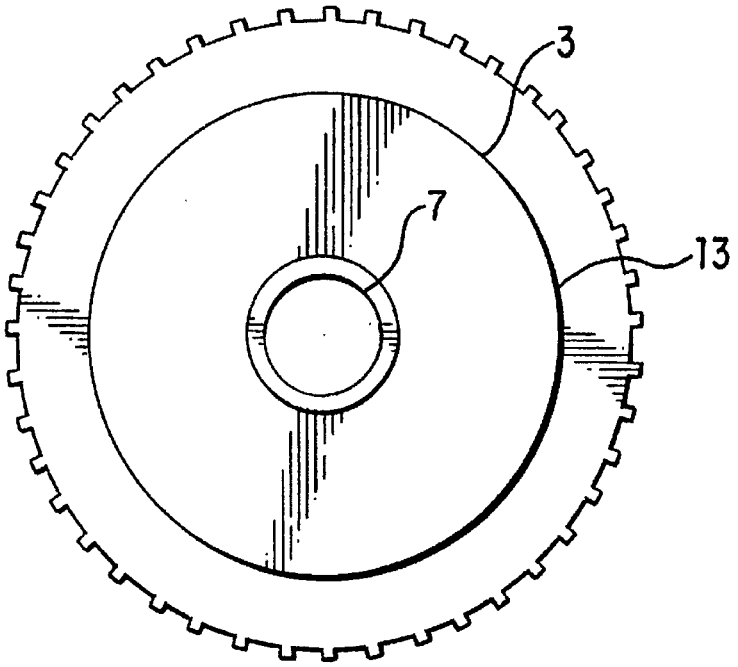
FIG. 3 is a plan view depicting the use of an expandable, substantially ring-shaped securing means according to another embodiment of the present invention.
Figure 4:
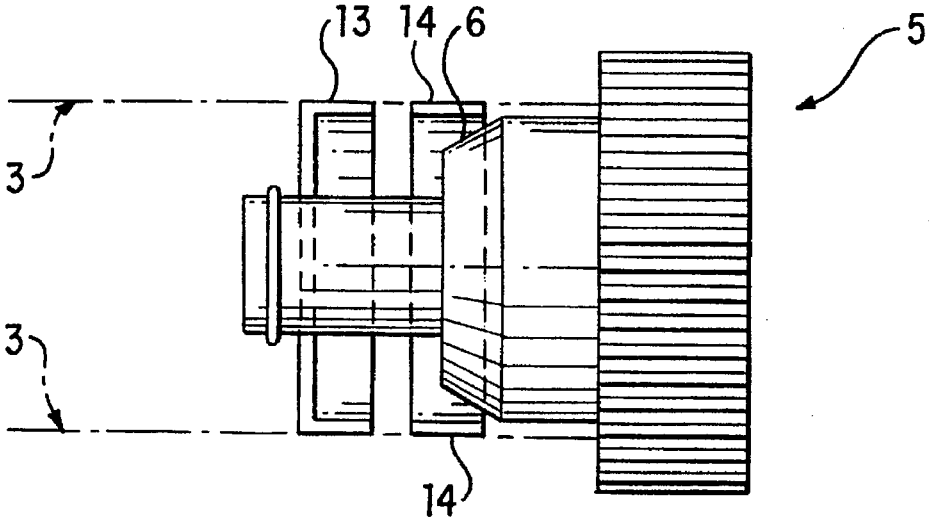
FIG. 4 is a side view depicting the placement of a reusable gear assembly using the expandable, substantially ring-shaped securing means within a photoreceptor according to another embodiment of the present invention.

A second embodiment of the invention is shown in FIGS. 3 and 4. As shown in FIG. 3 an expandable, substantially ring-shaped securing means 13 replaces the square leaf spring. This expandable ring (or square leaf spring) may be made out of metal or a conductive plastic. The expandable ring is placed inside an open end of the photoreceptor as shown in FIG. 4.

The inside surface 3 and the ring 13 have a very narrow clearance, (so narrow that the distance separating them is indiscernible in FIG. 3) such that when the gear assembly 5 is inserted, friction is created between the inside surface and ring. The gear assembly 5 is subjected to a torque in the direction of the protrusion's threads. This torque forces the ring 13 and the gear assembly 5 to move towards each other. The chamfered or wedge end 6 pushes ring extensions 14 outward towards the inside surface 3. This action produces additional stress between the ring 13 and the inside surface 3. This stress 'locks' the securing means or ring 13 to the inside surface 3 as well as securing the gear assembly 5 to the inside surface.

As will be recognized by one of ordinary skill in the art, the structure of the securing means is not limited to a leaf spring or expandable ring. In addition, securing means which contact the inside surface of a photoreceptor using substantially the entire outside circumferential surface of the securing means, such as the expandable ring 13, or those that only utilize certain portions of the securing means to contact the inside surface of a photoreceptor, such as the square leaf spring 1, may be used.

The above invention has been described with reference to particular embodiments. Modifications and alterations will occur to others upon reading and understanding this specification. It is intended that all such modifications and alterations are included insofar as they come within the scope of the claims or equivalents thereof.

What is claimed is:

1. A reusable photoreceptor assembly comprising:

a photoreceptor defining a central axis and having an inside surface and at least one substantially open end; and a reusable gear assembly selectively secured to the photoreceptor at the open end and having a substantially chamfered end for positioning within the open end of the photoreceptor, the gear assembly comprising:

a threaded protrusion extending from the chamfered end of the gear assembly;

expandable securing means threadably connected to the threaded protrusion for selective movement in a first axial direction towards the chamfered end upon rotation of the gear assembly in a first rotational direction about the central axis and in a second axial direction away from the chamfered end upon rotation of the gear assembly in a second rotational direction, a portion of said securing means contacting the chamfered end of the gear assembly, said securing means expanding radially upon movement in the first axial direction to lock the securing means against the inside surface of the photoreceptor to secure the gear assembly to the photoreceptor and contracting radially upon movement in the second axial direction to unlock the securing means from the inside surface of the photoreceptor to release the gear assembly from the inside surface of the photoreceptor.

2. The photoreceptor assembly as in claim 1, further comprising torque controlling means located on the protrusion for substantially limiting a position of the securing means.

3. The photoreceptor assembly as in claim 1, wherein said first rotational direction matches a drive direction of the photoreceptor.

4. The photoreceptor assembly as in claim 1, wherein the securing means is part of an electrical grounding circuit.

5. The photoreceptor assembly as in claim 1, wherein substantially all of an outside circumferential surface of the securing means moves against the inside surface of the photoreceptor.

6. The photoreceptor assembly as in claim 5, wherein the securing means is substantially ring-shaped.

7. The photoreceptor assembly as in claim 1, wherein less than all of an outside circumferential surface of the securing means moves against the inside surface of the photoreceptor.

8. The photoreceptor assembly as in claim 7, wherein the securing means is of a symmetrical geometric shape.

9. The photoreceptor assembly as in claim 8, wherein the securing means is a square leaf spring.

10. The photoreceptor assembly as in claim 1, wherein the securing means is substantially ring-shaped.

11. The photoreceptor assembly as in claim 1, wherein the securing means is a square leaf spring.

12. The photoreceptor assembly as in claim 2, wherein the torque controlling means is a lockout clip.

13. A reusable gear assembly comprising:

a gear;

a threaded protrusion extending from a chamfered end of the gear;

expandable securing means threadably connected to the threaded protrusion; and torque controlling means located on the protrusion for substantially limiting a position of the securing means on the protrusion.

14. The reusable gear assembly as in claim 13, wherein the securing means is substantially ring-shaped.

15. The reusable gear assembly as in claim 13, wherein the securing means is of a symmetrical geometric shape.

16. The reusable gear assembly as in claim 13, wherein the securing means is a square leaf spring.

17. The reusable gear assembly as in claim 13, wherein the torque controlling means is a lockout clip.

18. A method for reusably securing a reusable gear assembly to a photoreceptor such that substantially no damage occurs to an inside surface of the photoreceptor or to the gear assembly comprising:

inserting a portion of the gear assembly into an open end of the photoreceptor, said insertion causing expandable threaded, symmetrical shaped securing means to frictionally contact an inside surface of the photoreceptor; and applying a torque to the gear assembly in a drive direction of the photoreceptor, the torque causing the threaded, symmetrical shaped securing means to radially expand and lock the gear assembly to the inside surface of the photoreceptor.

19. The method of claim 18 further comprising controlling an amount of torque required to lock the gear assembly to the inside surface of the photoreceptor.

* * * * *